United States Patent [19]

Kutzner et al.

[11] 4,204,626

[45] May 27, 1980

[54] WIRE STAPLING APPARATUS

[75] Inventors: Willi A. P. Kutzner; Georg Schneider, both of Würzburg, Fed. Rep. of Germany

[73] Assignee: Koenig & Bauer Aktiengesellschaft, Würzburg, Fed. Rep. of Germany

[21] Appl. No.: 966,448

[22] Filed: Dec. 4, 1978

[30] Foreign Application Priority Data

Dec. 10, 1977 [DE] Fed. Rep. of Germany ..... 2755209

[51] Int. Cl.[2] ..... B25C 5/04

[52] U.S. Cl. ..... 227/81; 227/87; 227/91; 227/155

[58] Field of Search ..... 227/44, 81, 87, 91, 227/92, 99, 110, 111, 155

[56] References Cited

U.S. PATENT DOCUMENTS

| | | | |
|---|---|---|---|
| 2,211,027 | 8/1940 | Quick et al. | 227/81 |
| 2,224,743 | 12/1940 | Nolan | 227/87 |
| 2,818,568 | 1/1958 | Turrall et al. | 227/87 |
| 3,186,617 | 6/1965 | Fischer | 227/81 |
| 3,653,570 | 4/1972 | Alsop | 227/81 |

*Primary Examiner*—John McQuade

*Attorney, Agent, or Firm*—Jones, Tullar & Cooper

[57] ABSTRACT

A wire stapling apparatus for use in forming and inserting wire staples in folded copies is disclosed. The apparatus includes a rotating staple closing cylinder and a rotating wire stapling cylinder which cooperates with a wire staple forming piece to form a staple from a section of staple wire. The wire stapling cylinder carries a rotatable staple driving punch which rotates 90° between a staple receiving position and a staple driving position. The staple driving punch also reciprocates in the stapling cylinder to insert the staple into the folded product to be stapled. The staple closing cylinder carries suitable fixed and rotating staple shank bending devices.

16 Claims, 3 Drawing Figures

WIRE STAPLING APPARATUS

FIELD OF THE INVENTION

The present invention is directed generally to a wire stapling apparatus. More particularly, the present invention is directed to a wire stapling apparatus having a rotating staple closing cylinder and a cooperating rotating wire stapling cylinder. Most specifically, the present invention is directed to a wire stapling apparatus in which the wire stapling cylinder carries a rotatable and reciprocatable wire staple driving punch.

The wire stapling apparatus in accordance with the present invention is comprised generally of spaced, cooperating rotating cylinders with a first of these cylinders carrying suitable staple shank bending means and with a second cylinder carrying a staple driving punch which is capable of both rotating within the cylinder and reciprocating outwardly from the cylinder. A suitable staple wire cutting assembly is provided which cooperates with the second cylinder and a forming piece to form staples which are then driven by the driving punch into a folded or multisheet product or signature to be stapled, the signature or product being conveyed between the spaced cylinders.

DESCRIPTION OF THE PRIOR ART

Longitudinal wire stapling devices are generally known in the art and have been used for inserting and closing staples in copies. In these known devices, the copies have either been held stationary during the stapling operation or a stapling head portion of the device has moved along with the moving copy during the stapling operation. These known devices have been able to perform only a maximum of 12,000 stapling operations per hour.

SUMMARY OF THE INVENTION

It is an object of the present invention to provide a wire stapling apparatus capable of individually stapling separated multi-sheet copies utilizing a rotating staple closing cylinder and a cooperating rotating wire stapling cylinder.

Another object of the present invention is to provide a wire stapling apparatus in which forming of the staple and conveyance of the staple is effected at right angles to the direction of rotation of the wire stapling cylinder.

Yet a further object of the present invention is to provide a wire stapling apparatus in which infeed of the stapling wire to the wire stapling cylinder is done from outside the wire stapling cylinder.

Still another object of the wire stapling apparatus in accordance with the present invention is to provide a staple driving punch carried by the rotating wire stapling cylinder and being capable of both rotary and reciprocable motion in the wire stapling cylinder.

As will be discussed in greater detail in the description of a preferred embodiment set forth hereinafter, the wire stapling apparatus in accordance with the present invention is comprised generally of a rotating staple closing cylinder and a spaced, cooperating rotating wire stapling cylinder. The staple closing cylinder carries both fixed and rotary staple shank bending devices which close the staple shanks about a product being stapled. The stapling cylinder carries a rotating bushing within which a staple driving punch is positioned. During rotation of the stapling cylinder, the driving punch receives a piece of staple wire which is bent by a forming piece into the shape of a staple. The driving punch is then forced, by suitable means, radially outwardly from the stapling cylinder to insert the formed staple through the product where the shanks of the staple are bent over by the staple closing cylinder.

The wire stapling apparatus in accordance with the present invention has the particular advantages of providing a device that facilitates stapling of products with external staple wire infeed and that is capable of operating at a stapling speed in excess of 30,000 stapling operations per hour.

BRIEF DESCRIPTION OF THE DRAWINGS

While the novel features of the wire stapling apparatus in accordance with the present invention are set forth with particularity in the appended claims, a full and complete understanding of the invention may be had by referring to the detailed description of a preferred embodiment as set forth hereinafter and as may be seen in the accompanying drawings in which:

DESCRIPTION OF A PREFERRED EMBODIMENT

Figure 1:
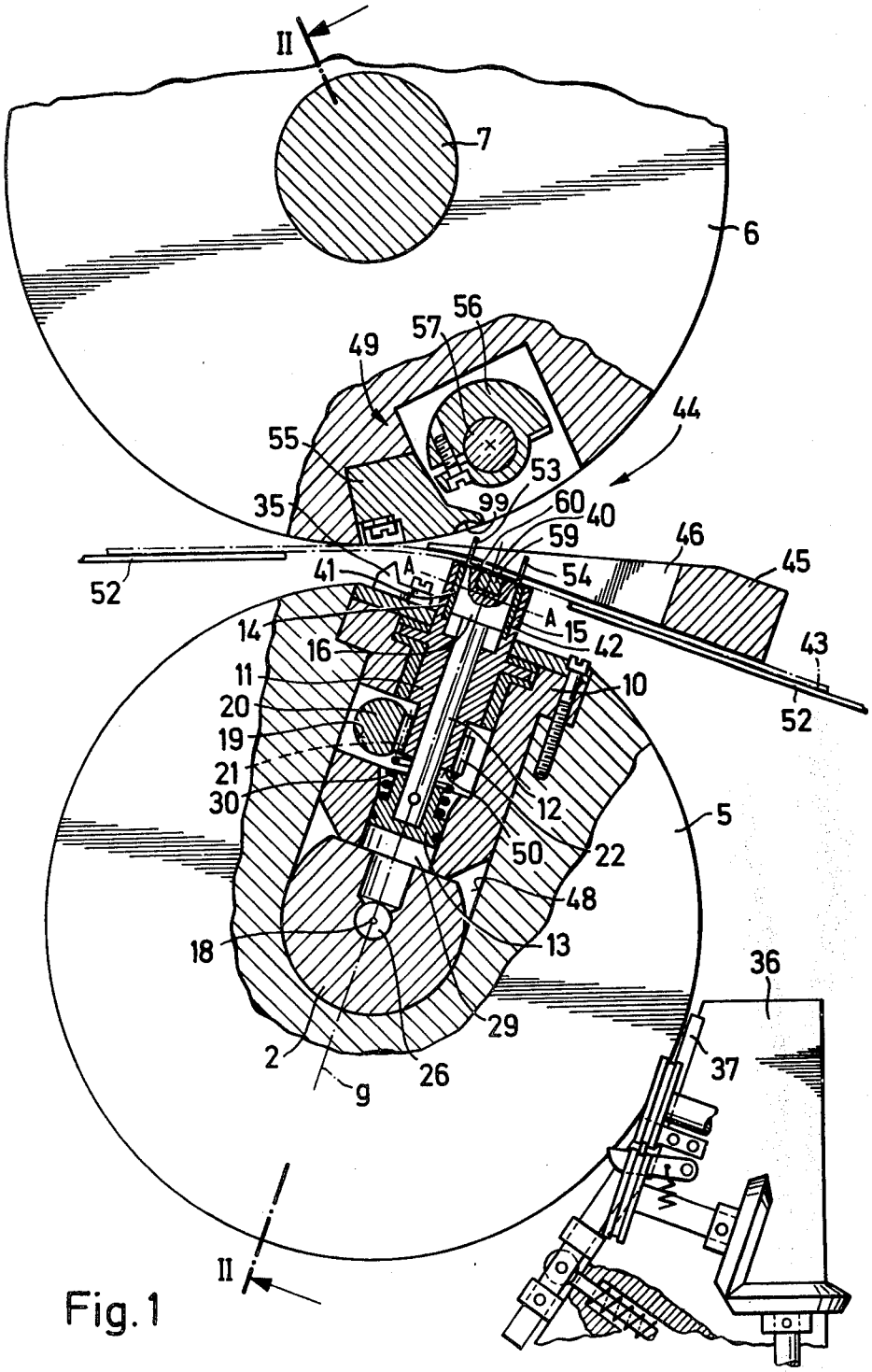
FIG. 1 is a side elevational view, partly in section, of the preferred embodiment of a wire stapling apparatus in accordance with the present invention with the supporting side frames removed for clarity
Figure 2:
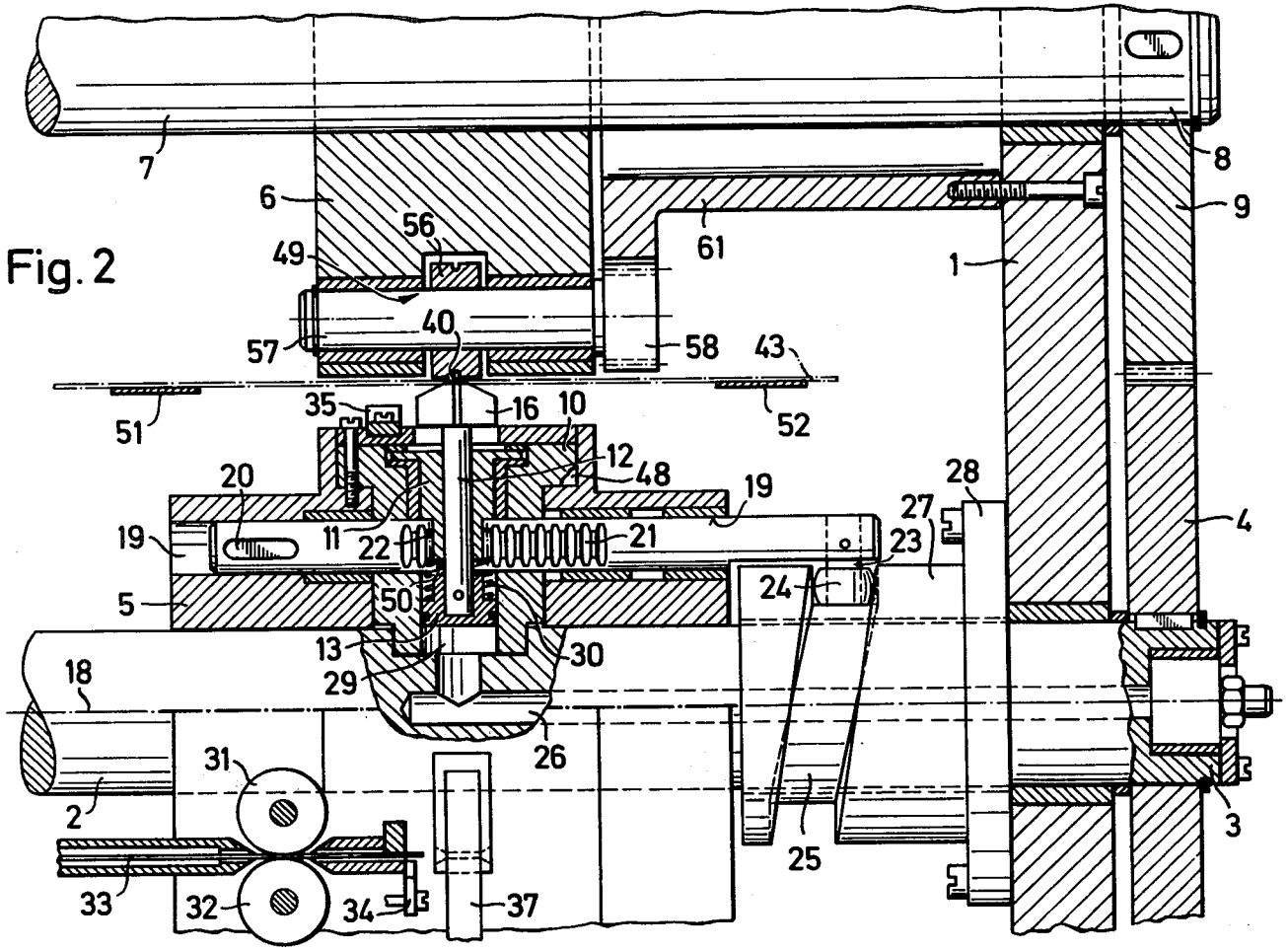
FIG. 2 is a partial cross-sectional view of the wire stapling apparatus of the present invention, taken along line II—II of FIG. 1; and, FIG. 3 is a schematic side elevation view of the wire stapling apparatus showing the wire staple forming operation.

Turning now to FIGS. 1 and 2, there may be seen a wire stapling apparatus in accordance with the present invention. The stapling apparatus is comprised generally of a wire stapling cylinder 5 and a staple closing cylinder 6. These two cylinders are rotatably mounted in a spaced position to allow passage of a multi-sheet copy or product 43 therebetween.

A shaft 2 is supported in side frame 1 and carries a driving gear 4 secured to end 3 of shaft 2. The wire stapling cylinder 5 is mounted on shaft 2, as may be seen in FIGS. 1 and 2. A similar shaft 7 is also secured to side frame 1 and carries a gear 9 at shaft end 8. Gears 4 and 9 cooperate with each other to drive stapling cylinder 5 on shaft 2 and staple closing cylinder 6 carried on shaft 7. Gear 4 is driven by a main drive gear which is not shown in the drawings.

A cylindrical sleeve 10 is fitted into a shouldered boring 48 provided in the wire stapling cylinder 5, as seen in FIGS. 1 and 2, and is secured in place. The cylindrical inserted sleeve 10 serves to support a rotatable bushing 11, in which a driving rod 12 and a piston 13, which is secured to the driving rod 12, are supported and are capable of being displaced radially. The rotatable bushing 11 carries, at its upper end, a pair of cross pieces 14 and 15, which serve to guide a staple driving punch 16 which inserts a staple 40. The driving punch 16 has a circular cross-section, from which two guiding surfaces, which extend parallel to each other, have been cut off. Due to this shape of its cross section, the driving punch 16 cannot turn within the space between the cross pieces 14 and 15, and must follow the rotational motion of the rotatable bushing 11. The rotatable bushing 11 and the driving punch 16 are capable of rotating around a straight radial line "g" passing through the center 18 of the wire stapling cylinder 5.

Parallel to the axis of rotation 18 of the shaft 2, a through boring 19 is provided in the wire stapling cylinder 5, as shown in FIG. 2. The boring 19 serves to support a half-round rack 20 which can be displaced in a reciprocating motion and which is provided wth gear teeth 21. The teeth 21 mesh with teeth of a rim gear 22 portion of the rotatable bushing 11. The rack 20 carries a journal 23 with a control roller 24 on its free extremity. The control roller 24 rotates in a switching groove portion 25 of a hollow cylinder 27 disposed concertrically about the shaft 2 and secured to the side frame 1 by means of a flange 28, as seen in FIG. 2. The switching groove 25 is dimensioned in a way such that the rack 20 makes one to-and-fro motion per rotation of the wire stapling cylinder 5, thus turning the rotatable bushing 11 through 90° around the straight line "g" with every rotation of cylinder 5. This rotational motion is also followed by the driving punch 16.

A radial boring 29 in sleeve 10, in which the piston 13 may reciprocally be moved, ends in a pocket boring 26 extending along the axis of rotation 18 of the shaft 2. This pocket boring 26 communicates with a driving means such as, for example, compressed air, which is infed under suitable control. A compression spring 30 is fixed between a front surface 50 of the rotatable bushing 11 and the piston 13. The object of the compression spring 30 is to drive the piston 13 back into the boring 29 if the normal driving means fails.

Figure 3:
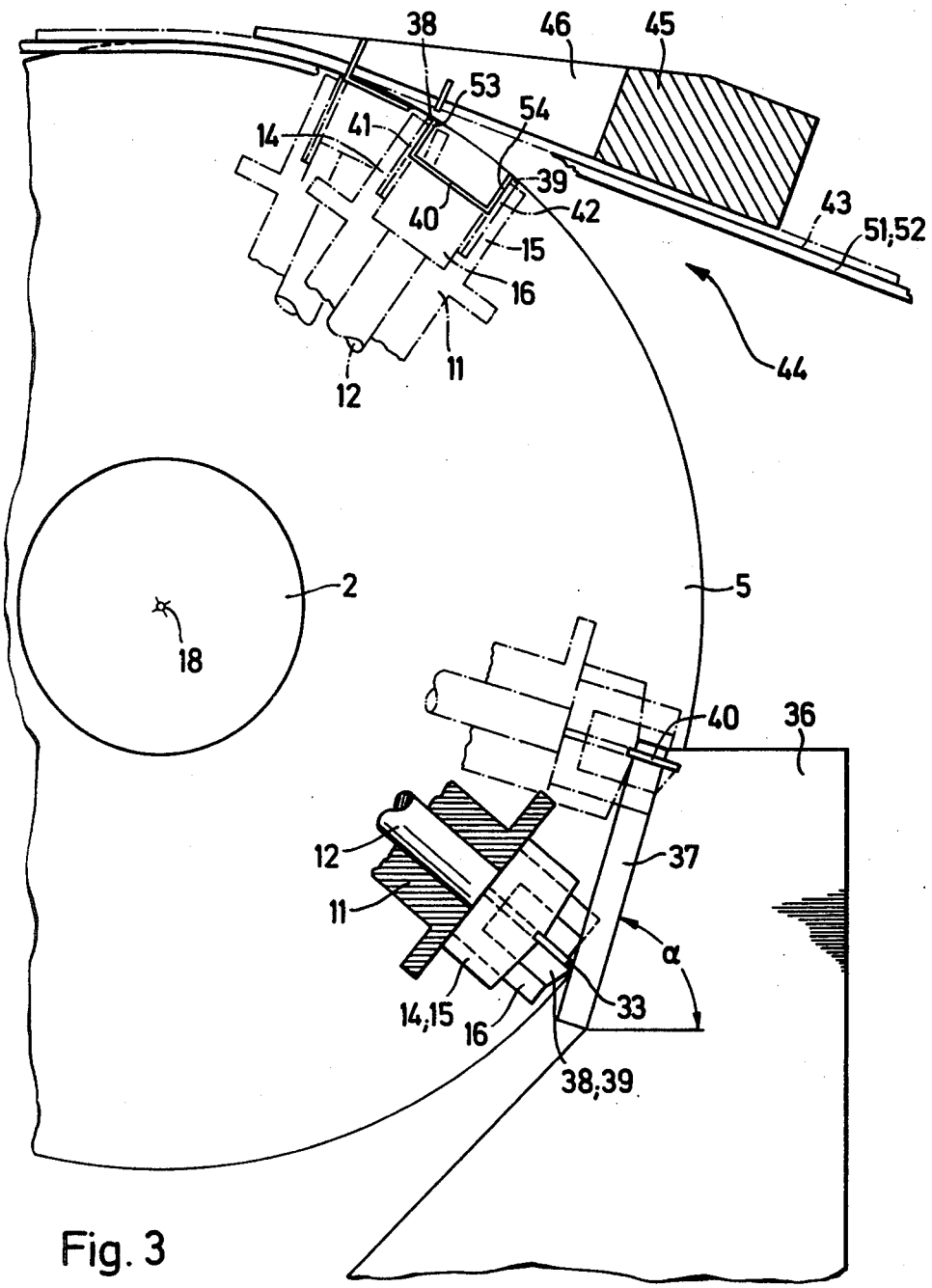

Stapling wire 33 is fed from a supply coil of wire, not shown, which is disposed outside the wire stapling cylinder 5, by means of conveyor rollers 31, 32 into a conventional wire cutting device 34, which is operated by means of a switching cam 35 carried on the wire stapling cylinder 5. A forming piece 37 is mounted on a support 36 fixed to the frame 1 at an angle $\alpha$ relative to a horizontal line as may be seen in FIG. 3, the forming piece 37 being disposed in manner such as to be located, during rotation of the wire stapling cylinder 5, between the cross pieces 14 and 15 of the rotatable bushing 11.

Before the driving punch 16 reaches the forming piece 37, its cross axis "A—A," as shown in FIG. 1, is adjusted to be parallel to the axis of rotation 18 of the wire stapling cylinder 5. In this position, driving tips 38, 39 of the rotatable bushing 11 engage the cut length of stapling wire 33, which wire was cut off by means of the wire cutting device 34, and convey it in the direction of rotation of the wire stapling cylinder 5. The stapling wire 33 is pressed between the cross pieces 14 and 15 by the obliquely positioned forming piece 37 into the driving punch 16, thus being formed into a staple 40. Staple 40 is retained between hard metal plate portions 41, 42, of the cross pieces 14, 15 of the rotatable bushing by a permanent magnet 59 inserted into the top surface 60 of the drive-in punch 16.

As the driving punch 16, with the formed staple 40, leaves the forming piece 37, the rack 20 is displaced by the positive guidance of the control roller 24 within the switching groove 25, to rotate the driving punch 16,90° around its longitudinal axis. The staple 40, which was formed at right angles to the direction of rotation of the wire stapling cylinder 5, is turned to a longitudinal position, that means in the direction of rotation of the wire stapling cylinder 5. The copy 43 to be stapled is conveyed by conveyor belts 51, 52, shown in FIGS. 1 and 2 and arrives between the wire stapling cylinder 5 and the staple closing cylinder 6.

A slotted guiding tongue 45 is fixed on the frame within the inlet wedge 44 between the cylinder 5 and 6. A guiding slot portion 46 of the guiding tongue 45 is dimensioned and adjusted in such a manner that shanks 53, 54, of staple 40 after having left the space between the cross pieces 14, 15 and having penetrated the copy 43, are driven into the guiding slot 46. The piston 13 is actuated by, for example, compressed air, so that the driving punch 16 forces the staple shanks to penetrate the copy 43 within the range of the guiding slot 46 of the guiding tongue 45. As soon as the staple shanks 53, 54 have penetrated the copy 43, it is impossible for the staple 40 to turn or deflect laterally, because the staple shanks 53, 54 are guided in the guiding slot 46.

The staple shanks 53, 54 are conveyed to the staple closing device generally at 49 which is carried on the staple closing cylinder 6 and which is comprised of a rigid staple shank bending insert 55 and a rotating staple shank bending device 56. Both staple shank bending devices 55, 56 are mounted on the staple closing cylinder 6. The staple closing cylinder 6 and its associated rigid staple shank bending insert 55 and rotating staple shank bending device 56 are set forth in full detail in German patent application No. P 27 55 210.9 filed in Germany on Dec. 10, 1977, entitled "HEFTKLAM VERSCHLIEBVORRICHIUNG" and assigned to the assignee of the present patent application. This German application corresponds to a U.S. patent application entitled "Staple Closing Mechanism", Ser. No. 966,449 filed Dec. 4, 1978. The rotating staple shank bending device 56 is carried on a shaft 57, the free end of which carries a pinion 58, which meshes with the teeth of a gear 61 fixed on the frame.

In operation, the wire stapling cylinder 5 and the staple closing cylinder 6 are rotated by gears 4 and 9, respectively. As the stapling cylinder 5 rotates, the rotatable bushing 11 is caused to rotate in sleeve 10 so that the staple driving punch 16 is provided with a staple 40 which has been formed from a piece of staple wire 33 by contact with the forming piece 37, as discussed hereinabove. The staple 40 is inserted through the product 43 by actuation of piston 13 to drive the staple driving punch 16 outwardly from the periphery of the stapling cylinder 5. As the staple shanks 53, 54 pass through the copy 43, they are held and prevented from displacing laterally by the guiding slot 46 of the guiding tongue 45. The first staple shank 53 engages a recessed portion 99 of the rigid staple shank bending insert 55 carried by the staple closing cylinder 6. This first staple shank is bent in a direction opposite to the direction of rotation of the cylinders 5 and 6. The second shank 54 of staple 40 is contacted by the rotating staple shank bending device 56 and is bent in the direction of rotation of cylinders 5 and 6. The rotating staple shank bending device 56 is caused to rotate in the same direction as staple closing cylinder 6 and at a speed substantially in excess of the speed of rotation of cylinder 6. Thus the wire stapling apparatus in accordance wth the present invention operates to form staples from stapling wire and to insert these staples through a copy and then to bend the staple shanks over so that the copy is securely stapled.

While a preferred embodiment of a wire stapling apparatus in accordance with the present invention has been fully and completely described hereinabove, it will be obvious to one of ordinary skill in the art that a number of changes in, for example, the drive means, the propulsion means for the staple driving punch, the substitution of a pre-formed staple feed for the staple forming piece, and the like could be made without departing from the true spirit and scope of the invention and that the invention is to be limited only by the following claims.

We claim:

1. A wire stapling apparatus comprising a rotatable staple closing cylinder and a rotatable wire stapling cylinder co-acting with the staple closing cylinder, the wire stapling cylinder having external stapling wire infeed, and means for cutting the wire and forming the cut wire into staples, for individually stapling separated multi-sheet copies, in which a staple conveyor and staple driving punch is disposed on the wire stapling cylinder, the staple conveyor and staple driving punch being capable of being rotated for 90° around a straight radial line extending outwardly from the center of rotation of the wire stapling cylinder, the staple conveyor and staple driving punch being rotatable about the radial line from a first position wherein the staple is formed to a second position wherein the staple is inserted.

2. An apparatus according to claim 1, in which said staple driving punch is supported capable of being displaced in a rotatable bushing, said rotatable bushing being supported concentrically relating to said straight radial line extending through the center of rotation of said wire stapling cylinder.

3. An apparatus according to claim 2 in which said driving punch is carried by a driving rod and a piston.

4. An apparatus according to claim 2 in which said rotatable bushing is equipped with a rim gear, said rim gear contacting gear teeth on a reciprocating rack; and in which a control roller is carried by means of a journal on said rack, said control roller being rotatably disposed in a switching groove of a hollow cylinder fixed on a frame portion of said wire stapling apparatus.

5. An apparatus according to claim 3, in which a compression spring is disposed between a front surface of said rotatable bushing and said piston.

6. An apparatus according to claim 1, in which a magnet is disposed on a top surface of said driving punch.

7. A wire stapling apparatus for receiving a staple, inserting the staple through a copy and for closing shank portions of the staple about the copy, said stapling apparatus comprising:

a rotatable wire stapling cylinder, said stapling cylinder carrying a staple driving punch in a rotatable bushing positioned in said stapling cylinder, said punch and bushing being rotatable in said cylinder between a staple receiving position and a staple inserting position;

means for driving said staple driving punch outwardly from a peripheral surface of said stapling cylinder to insert a staple through the folded copy;

means for supplying staples to said staple driving punch; and a rotatable staple closing cylinder, said staple closing cylinder having means for contacting the shank portions of said staples to close the shanks, said staple shanks being forced into contact with said shank closing means by said staple driving punch.

8. The wire stapling apparatus of claim 7 wherein said rotatable bushing carries a rim gear, said rim gear contacting gear teeth on a reciprocating rack.

9. The wire stapling apparatus of claim 8 wherein said rack is carried in a bore in said stapling cylinder, said rack extending out of said bore and carrying a control roller which rides in a switching groove portion of a hollow cylinder secured adjacent said stapling cylinder.

10. The wire stapling apparatus of claim 9 wherein said bushing rotates through 90° as said stapling cylinder rotates.

11. The wire stapling apparatus of claim 7 wherein said staple driving punch includes a driving rod and piston carried in said rotatable bushing.

12. The wire stapling apparatus of claim 11 wherein said piston communicates with pressurizing means to force said staple driving punch outwardly from said stapling cylinder.

13. The wire stapling apparatus of claim 12 wherein a compression spring urges said piston into said rotatable bushing to retract said staple driving punch into said rotatable bushing.

14. The wire stapling apparatus of claim 7 wherein said means for supplying staples to said driving punch includes staple wire feed means, a wire cutting means to sever said wire into staple lengths, and a forming piece to form said lengths of wire into said staples.

15. The wire stapling apparatus of claim 14 wherein said staple driving punch includes a magnet placed on a top surface of said punch to retain said staples during insertion into the folded copy.

16. The wire stapling apparatus of claim 7 wherein said staple closing cylinder includes a rigid staple shank bending insert and a rotatable staple shank bending device to close first and second shanks of each staple, respectively.

* * * * *